US008508373B2

(12) United States Patent
Rice

(10) Patent No.: US 8,508,373 B2
(45) Date of Patent: Aug. 13, 2013

(54) FLUID LEAK DETECTION AND ALARM

(76) Inventor: David Rice, Port Washington, WI (US)

( * ) Notice: Subject to any disclaimer, the term of this patent is extended or adjusted under 35 U.S.C. 154(b) by 339 days.

(21) Appl. No.: 13/112,785

(22) Filed: May 20, 2011

(65) Prior Publication Data

US 2011/0291845 A1 Dec. 1, 2011

Related U.S. Application Data

(60) Provisional application No. 61/348,998, filed on May 27, 2010.

(51) Int. Cl.
*G08B 21/00* (2006.01)

(52) U.S. Cl.
USPC ..... 340/605; 340/603

(58) Field of Classification Search
USPC ..... 340/603, 605, 618
See application file for complete search history.

(56) References Cited

U.S. PATENT DOCUMENTS

| | | | | |
|---|---|---|---|---|
| 4,594,638 | A * | 6/1986 | Suzuki et al. | 361/280 |
| 5,861,811 | A * | 1/1999 | Lease et al. | 340/618 |
| 6,281,801 | B1 * | 8/2001 | Cherry et al. | 340/605 |
| 6,463,796 | B1 * | 10/2002 | Van Mullekom et al. | 73/114.55 |
| 6,550,499 | B1 * | 4/2003 | Pai | 138/104 |
| 6,644,095 | B2 * | 11/2003 | Van Mullekom et al. | 73/10 |
| 2003/0011480 | A1 * | 1/2003 | Fehrenkamp | 340/573.6 |
| 2012/0275927 | A1 * | 11/2012 | Rhim | 417/36 |

* cited by examiner

*Primary Examiner* — Travis Hunnings
(74) *Attorney, Agent, or Firm* — James A Italia; Italia IP

(57) ABSTRACT

A method and a device are disclosed for reliably detecting fluid leaks while minimizing false alarms. A leak sensor in proximity of a flat leakage surface, such as a floor area, is used to sense a permittivity of a media, such as water, coming in contact with the leak sensor. Leak is indicated if the sensed permittivity exceeds a permittivity threshold within a predefined time period. The predefined time period indicates a rate threshold that if exceeded indicates relatively fast accumulation of fluid in an air gap between the leak sensor and the leakage surface, precluding or reducing the possibility of false alarm due to gradual increase in environmental humidity or moisture. The air gap defines a fluid volume that is substantially filled before leak is detected.

20 Claims, 5 Drawing Sheets

FIG. 1A
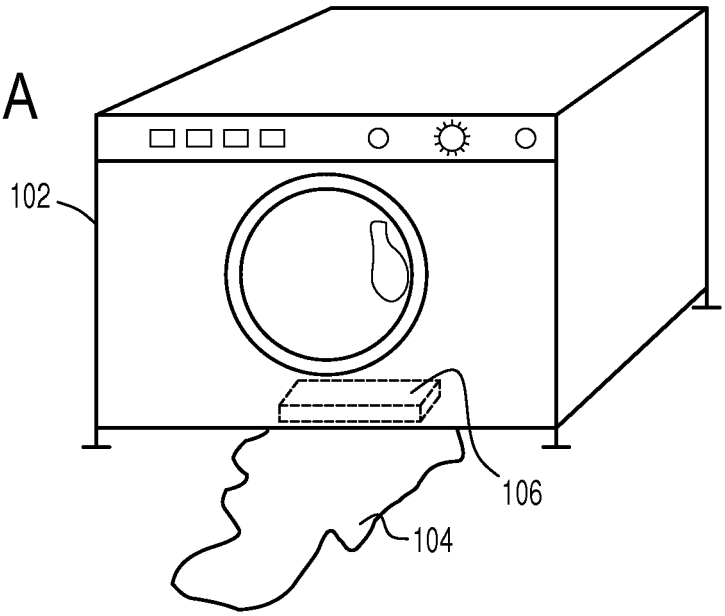
FIG. 2A
FIG. 2B
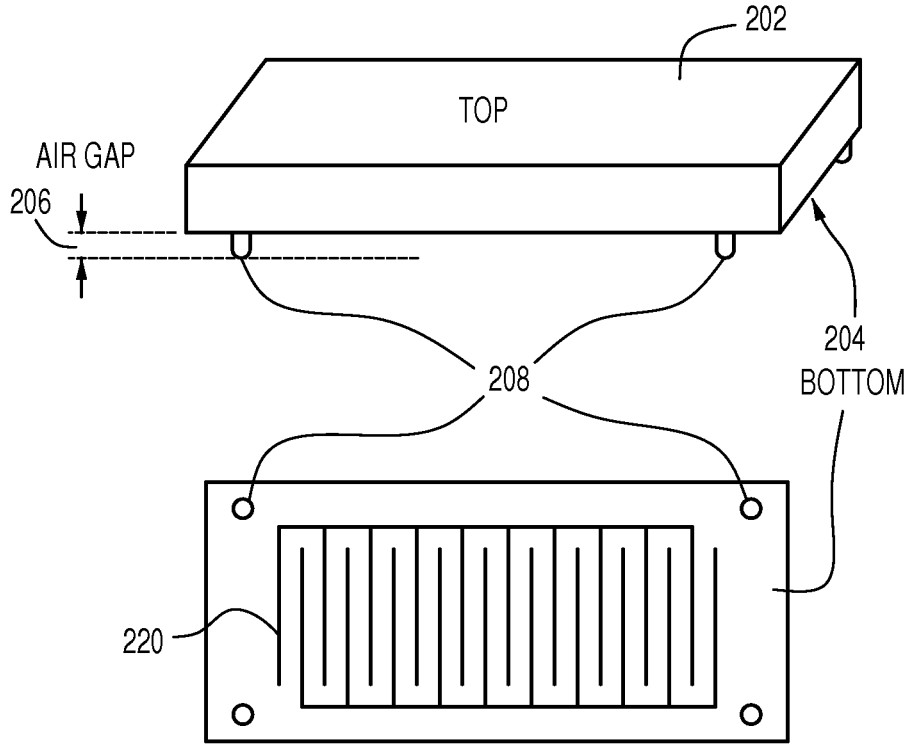

FLUID LEAK DETECTION AND ALARM

CROSS-REFERENCE TO RELATED APPLICATION

This application claims priority from U.S. Provisional Patent Application No. 61/348,998 entitled "FLUID LEAK DETECTION AND ALARM" filed on May 27, 2010. The entire contents of which are incorporated herein.

BACKGROUND OF THE INVENTION

This application relates generally to fluid leak detection. More specifically, this application relates to a method and apparatus for reliably detecting water leakage using permittivity.

SUMMARY OF THE INVENTION

In aspects of present disclosure, a fluid leak detection device is disclosed including a leak sensor configured to sense permittivity of an electric field in proximity of a fluid leakage. The fluid leak detection device further includes a microcontroller configured to track a rate of change of sensed permittivity of the electric field over time. The fluid leak detection device further includes an output stage configured to generate an alarm signal if the sensed permittivity exceeds a pre-determined permittivity threshold and if the rate of change of sensed permittivity exceeds a pre-determined rate threshold.

In further aspects of the present disclosure, a method of detecting fluid leak is disclosed. The method includes placing a leak sensor at a distance from a leakage surface, such as a floor, to form an air gap. The method further includes making a number of measurements of a permittivity of fluid in contact with the leak sensor and tracking the change in the measurements to generate a rate of permittivity change. The method further includes generating an alarm signal if the permittivity of the fluid exceeds a pre-determined permittivity threshold and if the rate of permittivity change exceeds a pre-determined rate threshold.

BRIEF DESCRIPTION OF DRAWINGS

The drawings, when considered in connection with the following description, are presented for the purpose of facilitating an understanding of the subject matter sought to be protected.

FIG. 1A is an example environment where a fluid leak detection device may be deployed;

FIG. 2A shows an example fluid leak detection device;

FIG. 2B shows an example sensor at a bottom surface of the fluid leak detection device of FIG. 2A;

DETAILED DESCRIPTIONS

Figure 3:
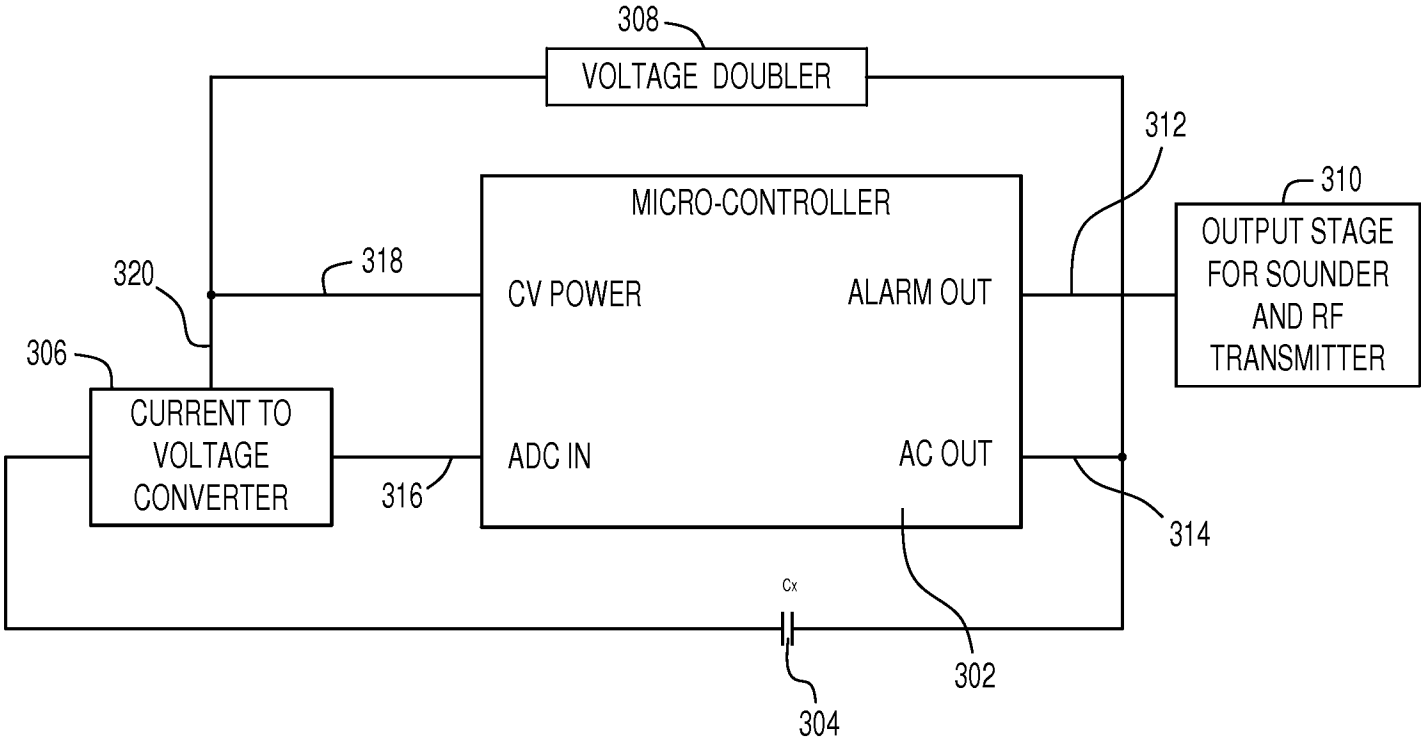
FIG. 3 shows a block diagram of an example circuit for detecting fluid leak.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while following description references water leak on flat horizontal floors, it will be appreciated that the disclosure may be used for other leak detections, such as non-water fluids on other surface types such as walls, ceilings, surfaces inside equipment and vehicles, and the like.

Briefly described, a method and a device are disclosed for reliably detecting actual fluid leaks while minimizing false alarms. A leak sensor in proximity of a flat leakage surface, such as a floor area, is used to sense a permittivity of a media, such as water, coming in contact with the leak sensor. Leak is indicated if the sensed permittivity exceeds a permittivity threshold within a predefined time period. The predefined time period indicates a rate threshold that if exceeded indicates relatively fast accumulation of fluid in an air gap between the leak sensor and the leakage surface, precluding or reducing the possibility of false alarm due to gradual increase in environmental humidity or moisture. The air gap defines a fluid volume that is substantially filled before leak is detected.

Permittivity is the resistance encountered in a material when forming an electric field. Permittivity is determined by the ability of the material to electrically polarize in response to the electric field, and thereby reduce the total electric field inside the material. As such, permittivity of a material defines the material's ability to transmit (or "permit") an electric field within the material.

In one embodiment, a flat insulated capacitor integrated with the leak detection device is used as the leak detection sensor, further discussed below with respect to FIGS. 2B and 5.

In another embodiment, a detached sensor is used. The detached sensor may be implemented using a pair of insulated wires, such as common telephone wires, which are lightly twisted together to form the capacitor for the leak detection sensor. The twisted pair of wires may be simply laid on the floor for leak detection. The change in capacitance in the twisted wires may be detected when a small quantity of water comes in contact with the pair of wires. This type of detached leak sensor may be used in places where the perimeter of an area needs to be monitored for leaks, as further described below with respect to FIG. 2B.

Many modern equipment and appliances, such as refrigerators, washing machines, condensers, tanks, and industrial equipment depend on water or other fluids for cooling, force transfer (for example, hydraulic equipment), and the like. Such equipment and appliances may also store water or produce water as a byproduct, such as water produced by condensers in refrigerators. More often than not, such equipment leak water or other fluids onto floors on which the equipment are installed. Water may also leak onto floors or other surfaces from rain, floods, broken pipes, and other natural and man-made sources. For example, water may leak from defective hot water heater tanks, flooded basements, storage spaces, room spaces below sea level, or from under other appliances such as washing machines, dishwashers and the like.

A number of techniques have been used to detect leaks. For example, float switches and electrical conduction may be used to detect leaks. These techniques have certain disadvantages. For example, float switches generally need an excessive volume of water before they are triggered, and the techniques that rely on electrical conduction between two or more contacts suffer from high sensitivity resulting in false alarms and contact corrosion resulting in no sensitivity and no alarms. The electrical conduction based techniques require the water to touch the contacts to close a circuit before an alarm is generated. The sensed area of leakage surface is often very small and if the water flows just to one side of that area, no alarm is generated.

FIG. 1A is an example environment where a fluid leak detection device may be deployed. Typically, the fluid leak detection device 106 is installed on the underside or placed under an appliance 102 to detect fluid leaks 104. In one embodiment, a single device is used. In other embodiments more than one device may be used to detect leaks. Multiple devices may be connected to a central controller to detect alarm signals generated by any one of the devices.

FIG. 2A shows an example fluid leak detection device. In one embodiment, the leak detection device includes an electronic sounder, electronic circuitry, batteries, and a flat insulated capacitor water sensor. All active and passive components may be housed in a small waterproof housing 202 with the flat insulated capacitor water sensor attached to the bottom 204 of the housing with a small air gap 206 between the sensor and the floor or leakage surface. The air gap may be created by small legs 208 setting the leak detection device off the floor and determining the size of the air gap. In one embodiment, legs 208 may be adjustable to adjust the size of air gap 206. The leak sensor may be used to measure the change in capacitance which is proportional to the volume of water displacing the air in air gap 206.

The leak detection device is used to detect wet environments such as water that leaks from appliances that may not be readily observable. In one embodiment, when water is detected, a loud, for example, 100+db (decibel), audible alarm is generated. In another embodiment, a radio signal indicating a leak alarm condition may be generated for receipt by a central control unit or a monitoring service. The radio signal may be generated in addition to or in place of the audible alarm. In yet another embodiment, a wired connection may be used to transmit a signal indicating a leak alarm condition. The wired connection may be a serial line, such as a phone line, a network line, such as Ethernet, and the like.

FIG. 2B shows an example sensor at a bottom surface of the fluid leak detection device of FIG. 2A. In one embodiment, the leak sensor is a capacitor at the bottom side 204 of the leak detection device facing where the leak is expected to occur. The sensor may be implemented using a fiberglass circuit board with a number of copper traces 220 inter-digited with each other as shown. The board and copper traces are coated with an electrically insulating film. The insulating film may be made of many different materials such as paint, solder resist, plastic film, and the like. Those skilled in the art will appreciate that many other patterns may be used to create the same function. The inter-digited layout forms a low value capacitor, Cx, for example, about 50 pico Farads (pF). Other capacitor values smaller or greater may be used to achieve substantially the same function. Surface mount electronic components may be mounted on the other side of the fiberglass circuit board.

In another embodiment detachable sensing insulated wires, loosely twisted together to keep them substantially parallel, may be placed under very low appliances or in a narrow space around an area where leaking water may collect, such as a hot water heater. Any water that comes in contact with the twisted wire may generate an alarm if certain thresholds are exceeded, as further discussed below. These wires may be loosely twisted together to keep them close to each other. Those skilled in the art will appreciate that many other techniques are available to keep the two wires close and essentially parallel to each other. These insulated wires may be of various wire gauges and lengths to accommodate the perimeter to be protected. Different insulating materials with various wall thicknesses may be used to adjust the performance parameters (for example, capacitance) of the sensor to suit different applications. Thicker wall insulation generally reduces sensor sensitivity. The air gap to allow the water to come in contact with the wires is naturally formed from the loose twisting, and also the tendency for the wires to touch only the floor in a few places that causes the wires to stay slightly above the floor.

FIG. 3 shows a block diagram of an example circuit for detecting fluid leak. In one embodiment, the leak detection device includes microcontroller 302 coupled with capacitor Cx or leak detection sensor 304, current-to-voltage converter (CV) 306, voltage doubler 308, and output stage 310. Microcontroller 302 typically has alarm output 312, AC (Alternating Current) output 314, ADC (Analog to Digital Converter) input 316, and CV power input 318. Alarm out 312 is coupled with output stage module 310. Current to voltage converter 306 is coupled with voltage doubler 308 via connection 320. Current to voltage converter 306 is coupled with micro-controller 302 via connection 316.

In one embodiment, microcontroller 302 controls the operation and timing of the leak detection device. The microcontroller also provides excitation for the sensor, measures the output signal from integrating current to voltage circuit 306, and drives the output sounder output stage 310. Those of ordinary skill in the art will appreciate that a microcontroller is generally configured as a small computer with most of the common computing components including a CPU (Central Processing Unit); various memory types such as RAM (Random Access Memory), ROM (Read Only Memory), non-volatile memory like flash; input/output ports such as serial and parallel ports; a small operating system; application software; internal clock/calendar; interrupt inputs; and the like. The various memories may be used to store measurements, settings, and perform various calculations such as rate of change calculations.

In operation, the electrically insulated leak detection sensor (capacitor) Cx works by measuring the permittivity of the substance touching the surface of sensor Cx. Air has a relatively low permittivity and water has a value approximately 80 times greater than air. When the measured permittivity of a material or media, such as water, in the proximity of leak detection sensor Cx exceeds a preset value, an alarm is generated, indicating a water leak. The leak sensor may be mounted horizontally underneath the leak detection device housing with a small air gap, for example, 1 to 2 mm, above the leakage surface on which water is to be detected, for example, a floor. This small gap serves at least two purposes, first, it isolates the sensor from the surface material (concrete, tile, wood, etc.) on which the leak detection device is standing, and second, it provides an accurately defined volume for the water to fill before the water is considered a leakage.

With reference to FIG. 2A now, the size of the air gap is designed to enable the leak sensor to come in contact with the leakage and successfully detect the leak. If there were no air gap underneath the leak detection device, the leakage water would not be able to flow under the device to come in contact with leak detection sensor Cx and the leak would not be detected. If the gap were too great, the water would flow under the sensor but would not touch its surface and would not be detected. The size of the air gap is determined to substantially optimize water entrapment. Additionally, a predetermined area of the sensor's insulated surface has to be in contact with water before permittivity is sufficiently changed to be regarded as being due to a leak. The sensor surface's water contact area in conjunction with the size of the gap defines substantially the minimum volume of water needed before an alarm is generated.

Figure 4:
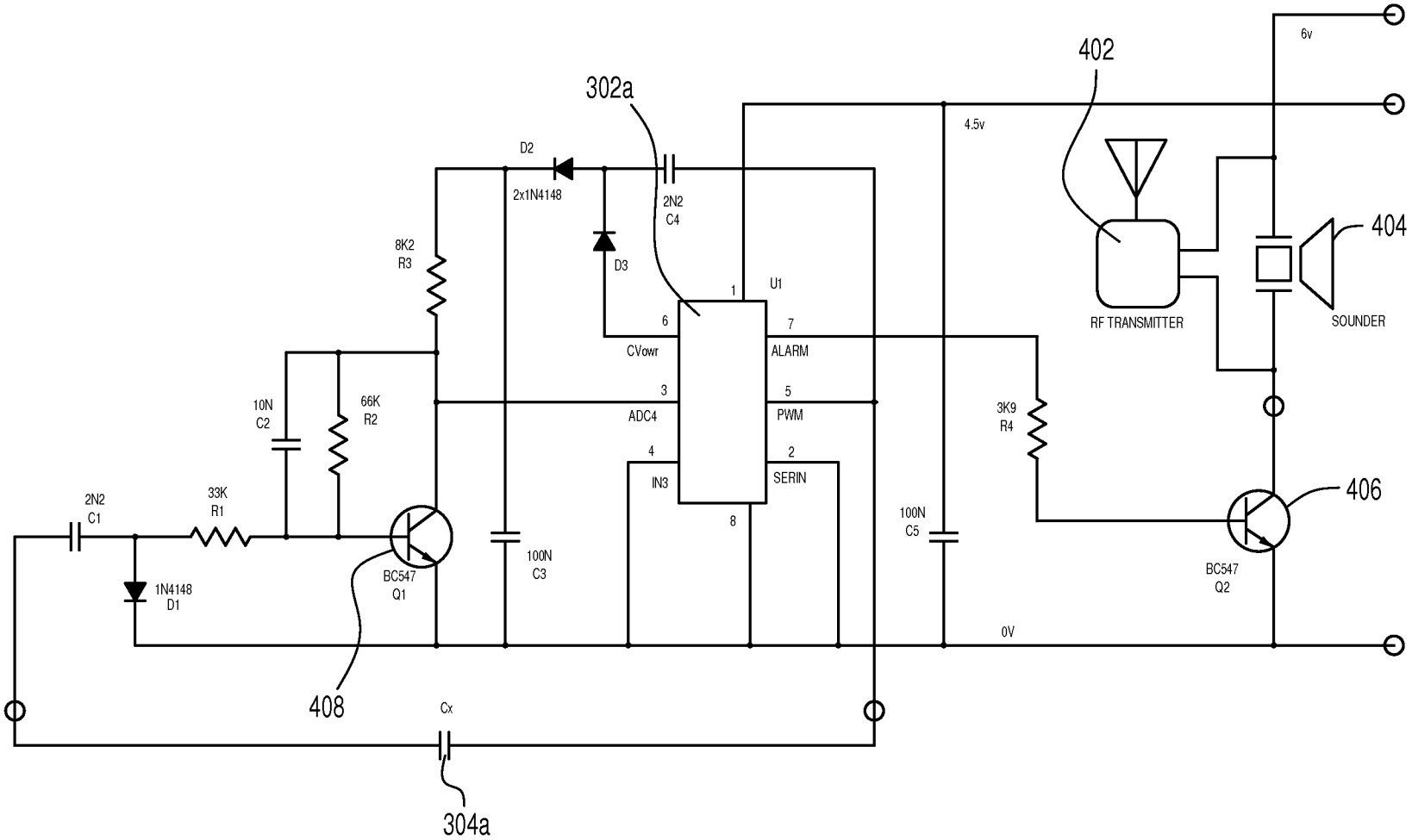
FIG. 4 shows an example circuit diagram of the block diagram of FIG. 3.

FIG. 4 shows an example circuit diagram of the block diagram of FIG. 3. In one embodiment, four functional blocks, as shown in FIG. 3, may be identified including Microcontroller 302, current to voltage converter 306, voltage doubler 308, and output stage 310. Those of ordinary skill in the art will appreciate that in other embodiments, more or fewer functional blocks may be used by combining some functional blocks and/or splitting one functional block into two or more functional blocks. Each functional block and the interaction between the functional blocks are further described below.

In one embodiment, a square wave signal, or another time-varying signal, is generated at pin 5 of microcontroller 302*a* (U1). Pin 5 is coupled with a first terminal of Cx, (leak sensor). A second terminal of Cx is coupled to another capacitor C1, typically of a relatively larger value compared to Cx, which may be used to block any direct currents (DC) arising from current leakage in Cx. Diode D1 is used to clamp/absorb the positive pulses of current through Cx but allow the negative current pulses to drive a first terminal of resistor R1 negative.

Transistor Q1 is connected as a self-biased, integrating, current amplifier. Capacitor C2 is the integrating capacitor, resistor R2 is the biasing resistor and resistor R3 is the load resistor. The pulsed, negative currents flowing in resistor R1 are averaged by the action of the circuit and generate a voltage proportional to the average of the pulsed currents flowing through leak sensor Cx. The greater the value of Cx, the greater the pulsed currents through resistor R1 and the higher the voltage on transistor Q1's collector.

Voltage doubler 308 may include capacitor C3, a reservoir capacitor, diodes D2 and D3, rectifying diodes, and capacitor C4, a charging capacitor. An AC power source to voltage doubler 308 may be the same square wave signal as used to generate current pulses in capacitor/sensor Cx, generated at U1 pin 5. A DC power source to voltage doubler 308 is the output from U1 pin 6 which, when high, switches current to voltage circuit 306 on. At least one purpose of this circuit is to increase the supply voltage for current to voltage converter 306 and enable an output of current to voltage converter 306 to maximize the signal into the microcontroller's ADC input, U1 pin 3.

Output stage 310 may include resistor R4 and transistor Q2. When the alarm pin, U1 pin 7, goes high, transistor Q2 is switched on and the sounder/RF 404 and/or transmitter/relay coil 402 are energized.

With continued reference to FIGS. 3 and 4, in operation, one terminal of the capacitor Cx is energized by an AC signal generated by the microcontroller. This signal may be a square wave at 64 kHz but many other waveforms and frequencies, such as sinusoidal or triangular waveforms, may be used to achieve substantially the same function. The amount of electrical current passed through capacitor Cx is proportional to the value of Cx, and thus, proportional to the permittivity of the material touching the surface of the capacitor Cx. Current Icx passing thorough capacitor Cx, is fed to the input of the current to voltage converter 306 and an output voltage is generated on output 316 that is proportional to current Icx, which is proportional to the permittivity of the material touching the surface of capacitor Cx.

This output voltage from output 316 is measured by the Analog to Digital Converter (ADC) in the microcontroller via pin 3 of U1. If the measured output voltage value is greater than a threshold value programmed into the microcontroller, then the output stage 310 for sounder 404 and/or RF transmitter 402 is energized and an alarm signal is generated.

Voltage doubler 308 is used to increase the supply voltage to the current to voltage converter 306 to optimize its performance.

Microcontroller 302*a* is in a low power mode most of the time to minimize power consumption, extending the battery life (if battery operated, in some embodiments) and 'wakes up' every few seconds, such as every 2.5 seconds. The capacitance of leak sensor Cx is then measured for a few milliseconds. The measured capacitance, corresponding to a water level and also a permittivity level, is compared to a preset alarm level, a permittivity threshold. If the capacitance is greater than the permittivity threshold, the water quantity is re-measured more accurately over a few seconds and only if the water is still above the alarm level will an alarm be generated. Most of the time no water is present and the measured alarm level value, the background level, is added to a running average of permittivity (corresponding to a water or moisture level) over a preset period, for example, a 45-minute running average. Microcontroller 302*a* returns to a low power mode for a further 2.5 seconds and the cycle repeats.

The running average slowly changes as the external environment, temperature, humidity and any moisture, changes. The capacitance level of leak sensor Cx corresponding to an alarm condition, the alarm level, is added to the permittivity running average and thus follows the environmental changes. Provided the quantity of water increases faster than the permittivity running average changes, an alarm is generated when the alarm level, corresponding to an accurate preset quantity of water as defined by air gap and leak sensor's sensing area, is exceeded. As such a minimum quantity of water must be present, over and above the background level, for an alarm to be generated. This quantity is generally not enough to cause water damage but is of a sufficient amount to indicate a leak may be starting. The chance of false alarms is greatly reduced by this approach.

Figure 5:
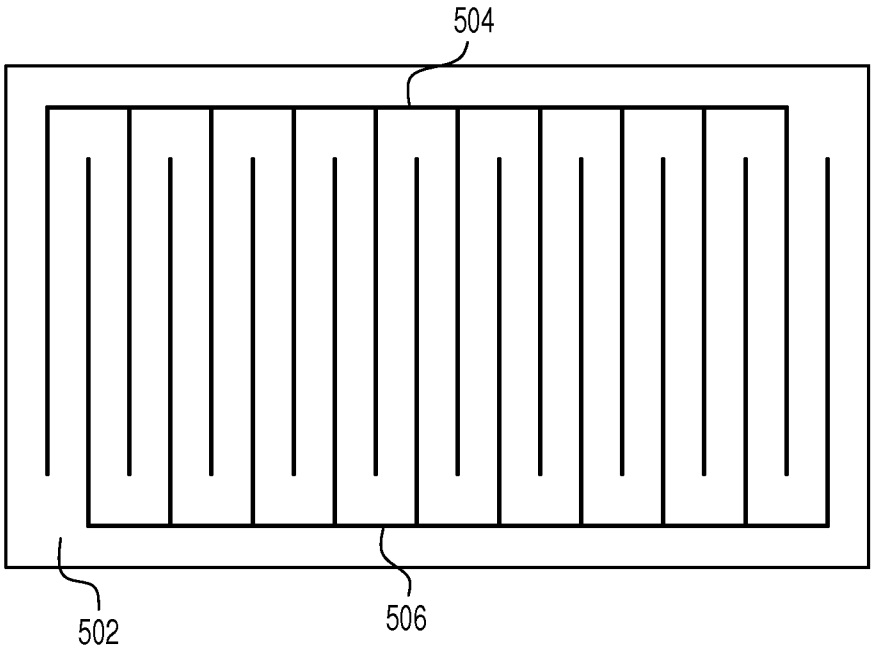
FIG. 5 shows an example pattern of a fluid sensing flat capacitor.

FIG. 5 shows an example pattern of a fluid sensing flat insulated capacitor. In one embodiment, a circuit board or other substrate 502 is used to create a flat capacitor between two capacitance plates or components 504 and 506. The components 504 and 506 may be implemented as an inter-digited pattern, increasing capacitor plate and charge area. Those skilled in the art will appreciate that many other patterns may be used to implement the capacitor plates. The surface of the flat capacitor is insulated to prevent the short-circuiting of the capacitor plates by moisture.

Figure 6:
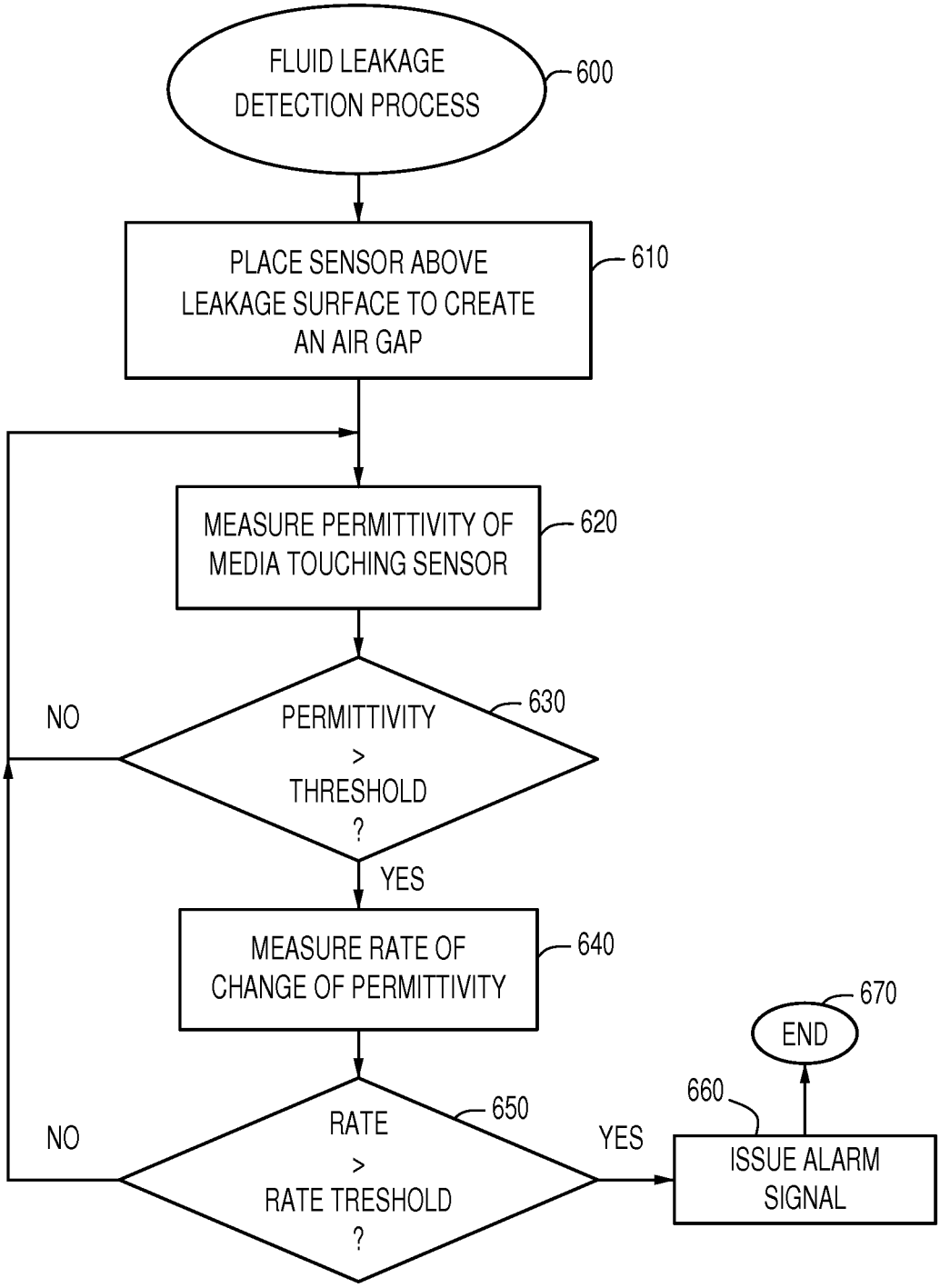
FIG. 6 is a flow diagram showing an example process for detecting fluid leak.

FIG. 6 is a flow diagram showing an example process for detecting fluid leak. Fluid leakage detection process 600 proceeds to block 610 where a sensor is placed above the leakage surface at a certain distance, defining an air gap. The air gap, in conjunction with the sensor area, defines a volume of water needed to start the leak detection process.

At block 620, permittivity of water touching the leak sensor is measured based on a change in the permittivity as indicated by a change in the capacitance of the leak sensor. Permittivity is measured only after the water fills the air gap and makes contact with the surface of the leak sensor. Therefore, a minimum volume of water, as defined by the volume of the air gap is needed before water is detected and considered as a leakage.

At block 630, the measured permittivity is compared with a permittivity threshold. Generally, the permittivity measured through a capacitor is related to capacitance of the capacitor and is affected by the amount of water in contact with the capacitor. In one embodiment, the permittivity threshold is preset for the environment in which the water leak detection device is used. In another embodiment, the permittivity threshold may be periodically adjusted to match expected conditions. For example, if the moisture is expected to change seasonally, the permittivity threshold may be adjusted accordingly, based on calendar date within the leak detection device and/or by direct programming. If the actual or measured permittivity exceeds the permittivity threshold, the process proceeds to block 640. Else, the process proceeds back to block 620.

At block 640, the rated of changed of permittivity, corresponding to sensed water/moisture is measured and tracked. A rate threshold is generally defined as an increase of water or moisture by a certain amount, as sensed by the leak sensor, over a defined time period. For example, if the water increases more than a certain amount such as 5 $mm^3$, corresponding to a certain permittivity, over a period of 2 minutes, then such a rate of increase, if faster than the preset rate threshold, may be considered to be a leakage. The rate of change of measured permittivity corresponding to a change in the capacitance caused by a change in the amount of water coming in contact with the capacitor (the sensor), is calculated with respect to previous permittivity measurements.

At block 650, the rate of change of permittivity is compared with the pre-determined rate threshold. If the permittivity changes faster than the pre-determined rate threshold, the process proceeds to block 660. Else, the process returns to block 620.

At block 660, an alarm signal is generated. In one embodiment, the alarm signal is generated in the form of a loud, for example, a 100 Db (Decibel) sound. In another embodiment, the alarm signal is issued in the form of a transmitted radio signal to alert a monitoring service, a central controller, or similar facilities. In yet another embodiment, the alarm signal is issued in the form of a digital signal or message transmitted via a wired network connection such as Ethernet. In still another embodiment, a combination of the above may be used to issue the alarm signal.

The process terminates at block 670.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

I claim:

1. A fluid leak detection device comprising:

a leak sensor configured to sense permittivity associated with an electric field in proximity of a fluid leakage;

a microcontroller, coupled with the leak sensor, configured to track a rate of change of sensed permittivity associated with the electric field over time; and an output stage coupled with the microcontroller and configured to generate an alarm signal if the sensed permittivity exceeds a pre-determined permittivity threshold and if the rate of change of sensed permittivity exceeds a pre-determined rate threshold.

2. The fluid leak detection device of claim 1, further comprising an air gap forming a volume configured to be substantially filled with fluid prior to generating the alarm signal.

3. The fluid leak detection device of claim 2, wherein the leak sensor is configured to sense the permittivity based on a change in a capacitance proportional to a volume of fluid displacing air in the air gap.

4. The fluid leak detection device of claim 1, wherein the leak sensor is a capacitor configured to change its capacitance when touched by fluid.

5. The fluid leak detection device of claim 1, the leak sensor comprises a twisted pair wire.

6. The fluid leak detection device of claim 5, wherein the twisted pair wire is insulated.

7. The fluid leak detection device of claim 5, wherein the twisted wire pair is configured to sense fluid leak by a change in capacitance of the twisted wire pair.

8. The fluid leak detection device of claim 1, wherein the alarm signal comprises an audible sound.

9. The fluid leak detection device of claim 1, wherein the alarm signal comprises a radio signal configured to be transmitted wirelessly to a monitoring station.

10. The fluid leak detection device of claim 1, further comprising a leak detection circuit coupled with the leak sensor.

11. The fluid leak detection device of claim 10, wherein the leak detection circuit is coupled with the microcontroller via a current to voltage converter.

12. A method of detecting fluid leak, the method comprising:

placing a leak sensor at a predetermined distance from a leakage surface to form an air gap;

making a plurality of measurements of a permittivity of fluid in contact with the leak sensor;

tracking the change in the plurality of measurements of the permittivity of the fluid to generate a rate of permittivity change;

generating an alarm signal if the permittivity of the fluid exceeds a pre-determined permittivity threshold and if the rate of permittivity change exceeds a pre-determined rate threshold.

13. The method of claim 12, further comprising transmitting the alarm signal to a monitoring station.

14. The method of claim 12, wherein the leak sensor is a capacitor configured to change its capacitance when touched by fluid.

15. The method of claim 12, wherein the leak sensor comprises a twisted pair wire.

16. The method of claim 12, wherein making a plurality of measurements of a permittivity of fluid comprises measuring a capacitance of the leak sensor.

17. The method of claim 12, wherein making a plurality of measurements of a permittivity of fluid comprises using a detection circuit to make the plurality of measurements.

18. The method of claim 12, wherein tracking the change in the plurality of measurements of the permittivity of the fluid comprises using a microcontroller to the track the change.

19. The method of claim 12, wherein generating an alarm signal comprises generating an audible sound.

20. The method of claim 12, wherein generating an alarm signal comprises generating a transmittable radio signal.

* * * * *

UNITED STATES PATENT AND TRADEMARK OFFICE

CERTIFICATE OF CORRECTION

PATENT NO. : 8,508,373 B2
APPLICATION NO. : 13/112785
DATED : August 13, 2013
INVENTOR(S) : Rice et al.

It is certified that error appears in the above-identified patent and that said Letters Patent is hereby corrected as shown below:

Title Page

Item (12) Should read Rice, et al.

Item (76) Should read Item (75)

Item (75) Inventors Should read

David Rice, Port Washington, WI (US); Daniel Fish, Bonita Springs, FL (US)

Signed and Sealed this
Twenty-fifth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,508,373 B2
APPLICATION NO. : 13/112785
DATED : August 13, 2013
INVENTOR(S) : Rice et al.

It is certified that error appears in the above-identified patent and that said Letters Patent is hereby corrected as shown below:

Title Page

Item (12) Should read Rice, et al.

Item (76) Inventors Should read

David Rice, Port Washington, WI (US); Daniel Fish, Bonita Springs, FL (US)

This certificate supersedes the Certificate of Correction issued August 25, 2015.

Signed and Sealed this
Tenth Day of November, 2015

Michelle K. Lee

Michelle K. Lee
*Director of the United States Patent and Trademark Office*